US006102486A

United States Patent [19]

Briese

[11] Patent Number: 6,102,486

[45] Date of Patent: Aug. 15, 2000

[54] FRUSTUM CUTTING BIT ARRANGEMENT

[75] Inventor: Leonard A. Briese, Harbor City, Calif.

[73] Assignee: Briese Industrial Technologies, Inc., Costa Mesa, Calif.

[21] Appl. No.: 09/256,436

[22] Filed: Feb. 23, 1999

Related U.S. Application Data

[63] Continuation-in-part of application No. 08/903,554, Jul. 31, 1997, Pat. No. 5,873,423.

[51] Int. Cl.[7] ..... E21C 35/183

[52] U.S. Cl. ..... 299/111; 299/113

[58] Field of Search ..... 175/426, 427, 175/430; 297/100, 112, 113; 299/111

[56] References Cited

U.S. PATENT DOCUMENTS

| | | | |
|---|---|---|---|
| 4,828,436 | 5/1989 | Briese | 407/76 |
| 4,893,967 | 1/1990 | Briese | 407/7 |
| 4,993,888 | 2/1991 | Briese | 175/427 |
| 5,873,423 | 2/1999 | Briese | 175/414 |
| 6,026,918 | 2/2000 | Briese . | |

*Primary Examiner*—Roger Schoeppel
*Attorney, Agent, or Firm*—Don Finkelstein

[57] ABSTRACT

A frustum cutting insert having a cutting end and a shank end and the cutting end having a cutting edge and inner walls defining a conical tapered surface. First walls in the insert define a cavity at the inner end of the inner walls and second walls define a plurality of apertures extending from the cavity to regions external the cutting insert to define a powder flow passage from regions adjacent the cutting edge, past the inner walls, through the cavity and through the apertures.

24 Claims, 10 Drawing Sheets

FRUSTUM CUTTING BIT ARRANGEMENT

REFERENCE TO RELATED APPLICATIONS

This application is a continuation in part of my U.S. patent application Ser. No. 08/903,554, filed Jul. 31, 1997 now U.S. Pat. No. 5,873,423.

BACKGROUND OF THE INVENTION

1. Field of the Invention

This invention relates to the field of rotary cutting tools, and in particular to an improved cutting bit arrangement for mounting to a rotary cutting tool which typically carries a number of such cutting bit arrangements on its body.

2. Brief Description of the Prior Art

Rotary cutting tools having a rotating body portion carrying a number of cutting bits are known in the art. Such rotating cutting tools may have as many as 100 or more cutting bits fixed to the body of the rotating cutting tool for cutting, drilling, surfacing, or otherwise forming holes, channels, or tunnels in, hard material or substance formations. Rotary cutting tools of this type are used extensively in the mining industry, in particular.

Replaceable cutting bits for mounting in, and to be retained by, a rotary cutting tool body are also well known. Such cutting bits have a shank portion insertable and locked into a cavity in the rotary tool body and a head portion projecting away from the rotary tool body, a number of separate cutting bits being carried by the rotary tool body. However, each projecting head portion of such a prior art cutting bit typically has a conical nose tip of tungsten carbide brazed on the end of the cutting bit head. The tungsten carbide tip contacts the material being cut in a gouging, scraping, or compression fracturing action, chipping away at the rock or earth strata by the thrust forces applied to the rotary tool body.

In this connection, rock, or stone, may be fractured by means of compressive or tensile forces. It requires much greater compression forces than tensile forces to fracture rock. Prior art rotating cutting tools generally drive their mounted cutting bits into the rock using compressive forces to fracture the rock. With such prior art cutting bits, the compressive fracture forces are directed only outwardly and in the cutting (drilling) direction from the cutter point. As a result, compared to tensile fracturing, greater horsepower is required, wear on equipment and tools is greatly increased, and excessive heat may be generated leading to possible explosion.

There are several other problems associated with such prior art cutting bits. A major problem is wear on the nose tip due to heat and pressure experienced in the cutting process. Such wearing down of the nose tip is not unexpected for a variety of reasons. First, in manufacturing the cutting bit, the tungsten carbide nose piece is the least dense at the extreme end of the conical tip where it is desired to be the most dense. This is due to the axial thickness of the nose piece tip being greatest between the base of the tip and its point. This is a known characteristic of formed tungsten carbide workpieces having regions of varying thicknesses. It would be desirable to have the cutting tip of a cutting bit formed of a hardened material, such as tungsten carbide, having high and constant density throughout.

Secondly, the heat generated during the brazing of a tip to a prior art cutter bit head degrades the hardness of the tip. It would be desirable to attach a cutting tip to a cutter bit without using high temperature techniques.

Thirdly, the same contacting portion of a prior art cutting bit hardened tip is exposed to the severe cutting engagement of the rock or substance being cut, and therefore builds up the temperature at the cutting tip, all contributing to a high wear rate. It would be desirable to provide a cutting bit tip which does not continuously present the same cutting portion of the cutter tip to the substance being cut, thereby allowing cooling of the portion of the cutter tip between cutting engagement strokes.

Additionally, it would be desirable to have the cutter tip effect tensile fracturing and a cutting action on the substance being cut, rather than employing compression fracturing or creating a gouging or scraping action as is made by the prior art conical nose cutting bits.

Prior art cutting bits have no provision to direct chips and debris away from the region being cut, so that debris around the cutting bits builds up and clogs the rotary cutting tool, at which time the rotary cutting tool must be withdrawn and cleaned, leading to inefficient drilling operation and costly down time and associated labor costs.

Another problem associated with prior art cutting bits is the cost of down time and labor involved with removal and replacement of worn or damaged cutting bits. It would be desirable to have a cutting bit with replaceable cutter tips, not practical with brazed-on carbide cone tips of the prior art.

A further problem often encountered with the prior art cutter bits in some applications is the formation of a "bubble" of highly compressed rock dust surrounding the tip of the cutter. Such bubble reduces the cutter efficacy in cutting the substance and creates a type of compression fracturing in the substance being cut rather than the desired tensile fracturing of the substance being cut. Further, it has now been found that the highly compressed dust "bubble" can inhibit the proper cutting operation in certain substances and a structure in the cutting tool is desired for venting such compressed dust and/or preventing a "bubble" from forming.

SUMMARY OF THE INVENTION

The above-noted problems and shortcomings associated with prior art cutting bits are overcome with use of cutting bits made in accordance with the present invention.

As described in my application Ser. No. 08/903,554 now U.S. Pat. No. 5,873,423, the invention described therein provides a frustum cutting bit arrangement comprising a shank portion, a head portion, and a frustum cutting insert. The shank portion mounts in, and is retained by, a rotary cutting tool body, the shank portion having an axis, an inner axial end, and an outer axial end. The head portion has an axis coincident with the shank portion axis, a front axial end, and a rear axial end, the rear end coupled to the shank portion outer end, and the front end having a conical cavity therein diminishing in diameter from the front end toward the rear end. The frustum cutting insert has an axis coincident with the head portion axis, a forward axial end, a back axial end, and an outer conical surface diminishing in diameter from the forward end toward the back end, the conical cavity and the outer conical surface having substantially the same taper, the frustum cutting insert fitting into the cavity in a taper lock.

In one aspect of the invention, a head and shank portion mount to a rotary cutting tool body, and a cutting insert is fixed to the forward end of the head portion in a taper lock action. An access hole is provided in the head portion for the insertion of a cutting insert removal tool for wedging the cutting insert out of taper lock with the head portion of the cutting bit arrangement by tapping on the removable tool. The cutting insert may have a conical tip or it may be frusto conical in shape at its forward end to provide a cutting action on the substance being cut or fractured as opposed to a gouging, scraping, or compressive fracturing action.

The invention described in my application Ser. No. 08/903,554 now U.S. Pat. No. 5,873,423 provides mainly tensile fracturing forces in combination with compressive forces. The combined tensile and compressive forces are directed inwardly as well as outwardly and in the cutting (drilling) direction from the cutting edge, greatly increasing cutting efficiency, reducing required driver horsepower, reducing wear on equipment and tools, and reducing heat generation. Notches or lugs on the cutting edge may be employed to increase the multidirectional fracturing forces.

In another aspect of the invention as described therein, there is provided a frustum cutting bit arrangement having a stator mounted to the rotary tool body and a rotor, or rotating head, portion having a frustum cutting insert fixed to the forward portion thereof in a taper lock, or having the frustum cutting insert rotatable within the rotatable head, both the head and the cutting insert being rotatable independently.

A number of different configurations for the stator, rotor, and cutting inserts are proposed, each with their advantages for particular applications.

According to the principles of the present invention, structure on the frustum cutter bit is provided to reduce and/or eliminate the "bubble" of highly compressed dust at the tip of the cutter in those applications where such bubbles tend to form. The structure so provided on the cutter bit generally comprises one or more venting passages in the frustum cutter bit extending from regions adjacent the center-line of of the frustum cutter bit to regions adjacent the external peripheral surface near the shank of the frustum cutter bit. Such passages allow the dust to vent from the volume at the front of the cutter bit to regions behind the cutter bit. Such venting prevents the build up of the highly compressed "bubble" at the front of the frustum cutter bit. Preferably, the passages are tapered with the small area at the center-line of the cutter bit and the large area at the peripheral surface. The taper helps maintain an even flow of the dust so that the passage ways do not become clogged or jammed by the dust.

In another aspect of the present invention, the frustum cutter bit may be fabricated from a material different from the material of the shank. For example, the cutter bit may be in fabricated from tungsten carbide, or similar material, and the shank fabricated from carbon steel. In such an embodiment, the outer end of the shank is formed with a cutter tip accepting aperture and the frustum cutter tip is placed in the aperture and secured therein by, for example, brazing.

BRIEF DESCRIPTION OF THE DRAWING

The above and other aspects of the present invention and variations thereof may be more fully understood from the following detailed description, taken together with the accompanying drawings, wherein similar reference characters refer to similar elements throughout, and in which FIGS. 33 through 36 illustrate the embodiments of the present invention:

FIG. 1 is a side view of a frustum cutting bit arrangement in accordance with the present invention in which a shank portion is connected to a head portion, the latter having an opening to receive and lock with a cutting insert in accordance with one aspect of the present invention;

FIG. 2 is a left end view of the arrangement shown in FIG. 1;

FIG. 3 is one variation of a cutting insert for the arrangement of FIG. 1;

FIG. 4 shows an alternative configuration for a cutting insert in the arrangement of FIG. 1;

FIG. 5 shows the cutting insert depicted in FIG. 1, removed from the FIG. 1 arrangement;

FIG. 6 is an end-on view of the cutting face of the frustum cutting insert of FIG. 5 showing exterior flutes;

FIG. 7 is a view similar to that of FIG. 6 and showing additional interior flutes on the cutting insert face;

FIG. 8 shows an alternative embodiment of a frustum cutting bit arrangement having a stator and a rotatable head, as well as a rotatable cutting insert in the rotatable head;

FIG. 9 is a left end view of the arrangement of FIG. 8 showing the addition of flutes formed on both the head and frustum cutting insert;

FIG. 10 is a view similar to that of FIG. 9 with the flutes on the insert and head being oppositely angled;

FIG. 11 is an enlarged view of the forward section of the rotating head and rotatable frustum cutting insert of FIG. 8;

FIG. 12 is a view of the cutting insert shown in FIGS. 8 and 11 illustrating the construction permitting the frustum cutter bit to rotate within the cutting insert;

FIG. 13 depicts a further embodiment of a rotatable head portion for a cutting bit arrangement having a fixed cutting insert holding a fixed cutter bit;

FIG. 14 is a left end view of the head portion shown in FIG. 13;

FIG. 15 is an enlarged view of the forward section of the head portion shown in FIG. 13;

FIG. 16 is a side view of a cutter bit insertable into the cutting insert shown in FIG. 13;

FIG. 17 is a partial side view showing the cutting insert and cutter bit prior to installing the cutter bit in the cutting insert of the head portion according to the embodiment of FIG. 13;

FIG. 18 shows a further embodiment of a rotatable head portion having flutes on its outer forward conical surface;

FIG. 19 is a left end view of the head portion shown in FIG. 18;

FIG. 20 is a side view of the shank or stator portion of the cutting bit arrangement which can accommodate the rotatable heads shown in FIGS. 13 or 18;

FIG. 21 is a left end view of the shank portion of FIG. 20;

FIG. 22 is illustrative of a further embodiment of the invention, similar in construction to those shown in FIGS. 13–20 and illustrating the bearing components permitting the head portion to rotate relative to the shank portion, and with a variation of the cutting bit inserted in the head portion;

FIG. 23 is a left end view of the arrangement shown in FIG. 22;

FIG. 24 is a side view of the cutter bit arrangement removed from the arrangement shown in FIG. 22, the cutter bit including an insert bit and a holder for the insert bit;

FIG. 25 is a left end view of the cutter bit of FIG. 24;

FIG. 26 is a side view of the holder for the insert bit of the cutter bit arrangement shown in FIG. 24;

FIG. 27 depicts the insert bit part of the cutter bit shown in FIG. 24;

FIG. 28 is an enlarged view of the shank inner end and head rear end with reference to the arrangement shown in FIG. 22;

FIG. 29 is an alternative cutting insert having a number of varying sizes of pimples on its outer conical surface;

FIG. 30 is a left end view of the cutting insert shown in FIG. 29;

FIG. 31 is an alternative cutting insert having a number of varying sizes of dimples on its outer conical surface;

FIG. 32 is a left end view of the cutting insert of FIG. 31;

FIG. 34 illustrates another embodiment of a frustum cutting insert according to the principals of the present invention;

FIG. 35 illustrates the mounting of the cutting insert of FIG. 34 in a mounting body; and, FIG. 36 illustrates another embodiment of the present invention.

DETAILED DESCRIPTION OF THE PREFERRED EMBODIMENTS

As noted above, FIGS. 1 through 32 illustrate my invention as set forth in my application Ser. No. 08/903,554 now U.S. Pat. No. 5,873,423. An understanding of the principles thereof provides a more complete understanding of the principles of the present invention.

As described in the above mentioned application Ser. No. 08/903,554, FIG. 1 shows an example of the present invention in which a frustum cutting bit arrangement has no rotatable parts, although the entire cutting bit arrangement 1 itself may rotate within a cavity of a rotary cutting tool.

Figure 1:
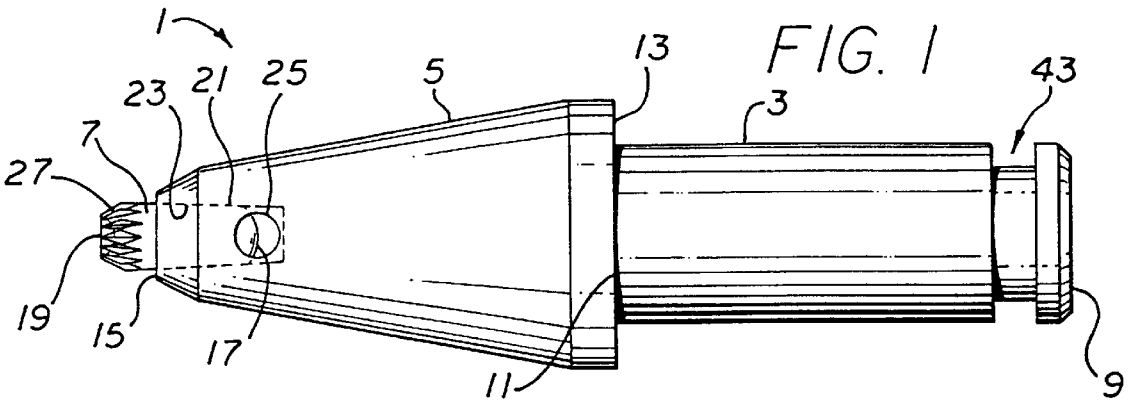
FIGS. 1 through 32 illustrate the invention as set forth in my application Ser. No. 08/903,554 now U.S. Pat. No. 5,873,423
Figure 2:
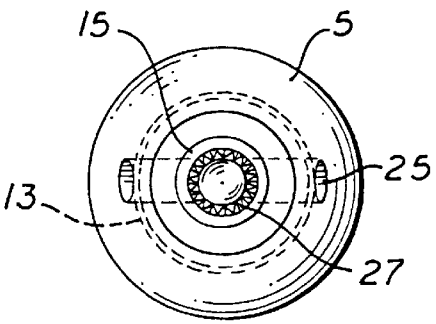

As shown in FIG. 1, a frustum cutting bit arrangement 1 has a shank portion 3 and a head, or body, portion 5 of conical shape diminishing toward the forward end thereof. The shank portion 3 is retained in a rotary cutting tool body (not shown) by any known means, for example by a locking ring (not shown) captured in annular groove 43.

A frustum cutting insert 7 is taper locked into the front end of head 5 in a manner commonly known in the mechanical art. The shank portion 3 has an inner end 9 and an outer end 11, the latter being attached to, or formed with, a rear end 13 of head 5. The head 5 has a front end 15 within which a frustum cutting insert 7 is taper locked. The frustum cutting insert has a back end 17, a forward end 19, and a tapered conical outer surface 21 taper locked to the inner tapered conical surface 23 of head 5.

Figure 1A:
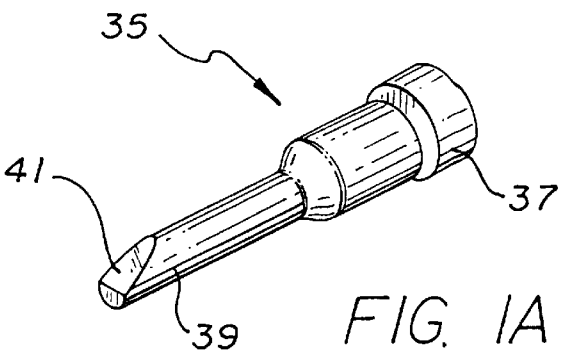
FIG. 1A is a perspective view of a cutting insert removal tool.

An access opening 25 for a removal tool 35 (FIG. 1A) is provided in the side of head 5, whereby a tapered wedge tip 41 of the tool, at the end of the tool shaft 39, is effective to push the frustum cutting insert 7 out of taper lock with head 5 by tapping on the head 37 of the insert removal tool 35. In other embodiments of the invention to be described hereinafter, it will be understood that the tool of FIG. 1A can be used to remove the taper locked insert from the head in a similar manner to that described in connection with FIG. 1.

Figure 3:
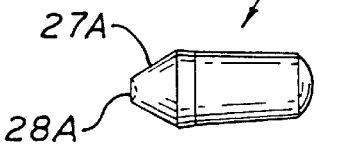
Figure 4:
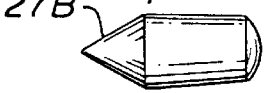
Figure 5:
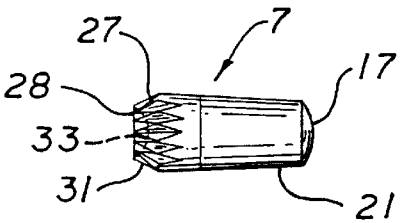
Figure 7:
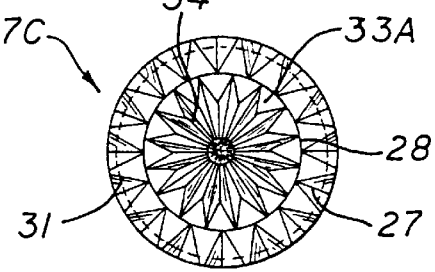

FIGS. 3–5 show three different configurations for the tip portion of the cutting insert 7, and it will be understood that a variety of other possibly configurations and geometries are within the scope of the present invention, the variations shown in FIGS. 3–5 being exemplary only.

Figure 6:
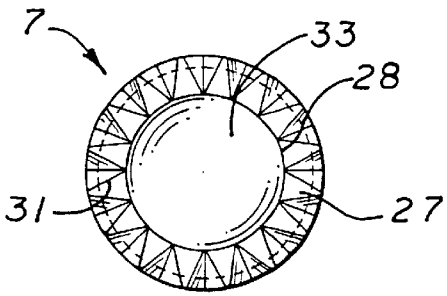

The forward end of cutting insert 7A shown if FIG. 3 is a frusto conical tip 27A presenting a circular cutting edge to the material or substance being cut. In FIG. 4, the cutting insert 7B shows a conical tip 27B. The fluted frusto conical tip 27 shown in FIG. 5 is the same as that shown in FIG. 1, the fluted tip being formed with exterior flutes 31 as shown in FIG. 6 or with exterior flutes 31 and interior flutes 34 as shown on cutting insert 7C in FIG. 7. An obvious alternate variation is a fluted tip having only interior flutes (not shown). It should be noted that each frustum cutting insert 7, 7*a* has a concave depression 33 which, when meeting with the inwardly tapered tip portion 27, 27A, forms a circular cutting edge 28, 28A.

Figure 8:
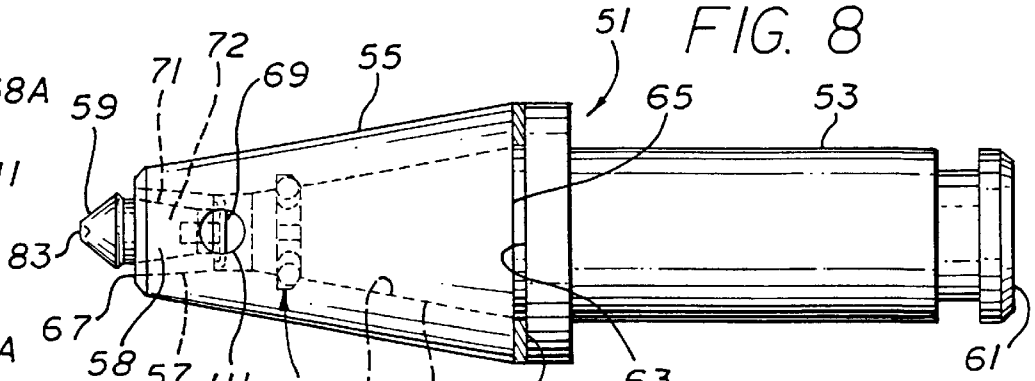

FIG. 8 is an embodiment of the invention in which the head and cutting insert both are rotatable. As shown in FIG. 8, a frustum cutting bit arrangement 51 has a shank or stator portion 53 having an inner end 61 and an outer end 63, a head or rotor portion 55 having a rear end 65 and a front end 67, and a rotatable cutting bit insert arrangement 57 carrying a cutting bit 58. An access opening 111 is provided in head 55 for removal of insert 57 as hereinbefore described.

Figure 11:
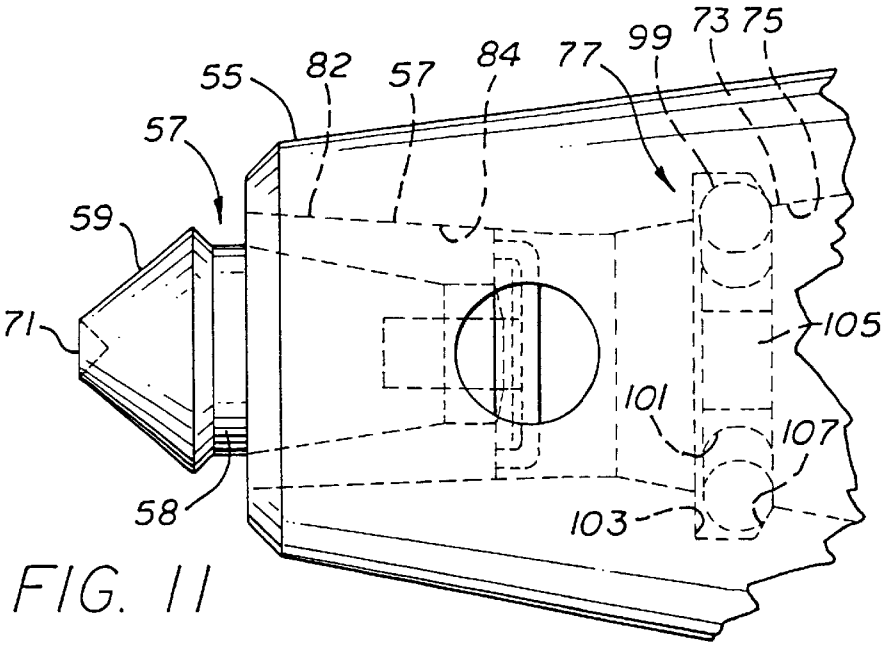
Figure 12:
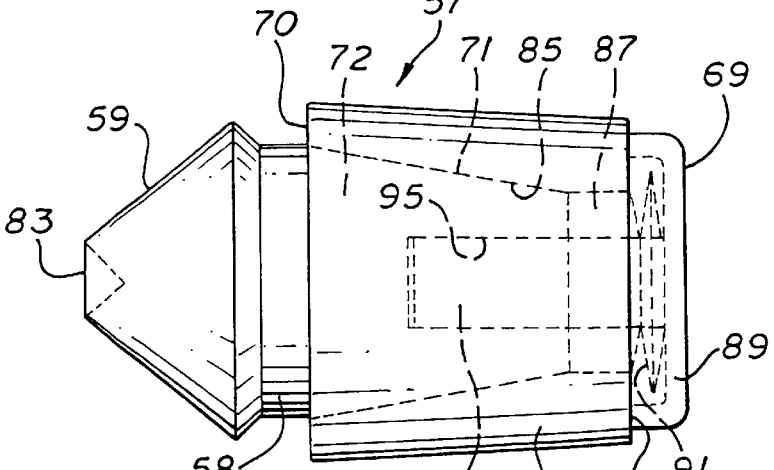

FIGS. 11 and 12 are enlarged portions of FIG. 8 which may assist in understanding the structure and function of the FIG. 8 embodiment.

The outer end of shank 53 has a forward end with an outer conical bearing surface 73 being in surface contact with an interior conical bearing surface 75 formed in the head 55. Preferably, the contacting bearing surfaces 73, 75 are treated with a diamond coating, available from QQC, Inc. of Dearborn, Michigan, to reduce the sliding friction between the mating conical surfaces.

Figure 9:
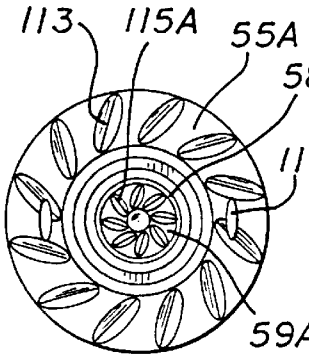
Figure 10:
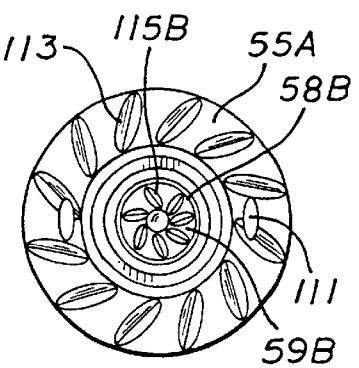

Since both the head 55 and frustum cutting insert 58 are rotatable relative to each other and relative to the shank portion 53, advantage can be taken of this dynamic relationship by providing a pattern of grooves or flutes on the outer surface of the head portion 55 and the outer portion of the insert tip 59 as shown in the right end views of FIGS. 9 and 10. In FIG. 9, for example, the flutes 113 on the surface of head portion 55A are angled relative to the axis of the cutting bit arrangement in the same angular direction as the smaller flutes 115A formed on the insert tip 59A of the rotatable frustum cutter bit 58A. As mentioned previously, these grooves or flutes 113 serve to direct particles, chipped from the surface being cut, away from the cutting operation to avoid clogging of the cutting bit arrangement or the entire rotary cutting tool.

In FIG. 10, the fluted head portion 55A is the same as that shown in FIG. 9, but the insert tip 59B on cutter bit 58B has its flutes 115B angled in the opposite direction than those on the tip 59A. In this manner, when the head and cutter bit rotate, they tend to direct debris in opposite directions for a more even distribution of the debris away from the vicinity of the cutting operation.

FIG. 11 is an enlarged view of the forward portion of head 55 shown in FIG. 8 to illustrate the axial locking mechanism 77 which locks the shank portion 53 to the head portion 55 axially but permits relative rotation therebetween. In the forward end of the inner conical surface 75 of head 55, an annular groove 103 is formed. Likewise, in the forward portion of the outer conical surface 73 of the shank portion 53, an annular groove 101 is formed. A circular locking ring 99, shown in phantom cross section in FIG. 11, has a predetermined relaxed diameter as shown in FIG. 11, i.e.

with the center of the circular cross section of the locking ring 99 located approximately at the interface between the mating conical surfaces 73 and 75. In this configuration, the head 55 is locked onto the shank portion 53 due to the locking of the walls of annular grooves 101 and 103 by the circular locking ring 99.

Locking ring 99 has an opening 105 along its circular length for collapsing the circular locking ring 99 inwardly, i.e. radially inwardly and seating more deeply into the annular groove 101 formed in the shank portion 53.

In order to more easily collapse circular locking ring 99, the inner wall surface 107 of annular groove 103 may be tapered rearwardly. As a result, applying a force tending to separate the head 55 from the shank portion 53 will cam the circular locking ring 99 inwardly by the tapered edge 107, until the locking ring 99 is inserted far enough into groove 101 that the inner surface 75 of head 55 will pass over the collapsed locking ring 99. Upon replacement of the rotatable head 55, the inner conical surface 75 of the head 55 gradually cams the circular locking ring 99 inwardly until it snaps back into annular groove 103 as shown in FIG. 11.

It will be noted that the normal locked position for locking ring 99 within annular groove 103 is such that the ring 99 contacts the rear tapered surface 107. This is due to a preload being applied to the head 55 as the circular locking ring self-expands radially outwardly to cam surface 107 rearwardly and bring the bearing surfaces 73, 75 into mutual engagement.

FIG. 12 is an enlarged view of the forward portion of the arrangement shown in FIG. 8 depicting the elements comprising the rotatable cutting bit insert arrangement 57. A taper lock bearing sleeve 81 has an outer conical surface 82 taper locking with an inner conical surface 84 of the head portion 55 (see FIGS. 8 and 11). Accordingly, sleeve 81 is taper locked to head 55 and does not rotate relative to the head 55. However, the inner conical surface 85 of the taper lock bearing sleeve 81 is a bearing surface against which the outer bearing surface 71 of a cutter bit 58 bears in a preload condition by the effect of compression spring 91 tending to press bearing cap 89 outwardly. Compression spring 91 may be helical, split ring type, or, preferably one or a stack of belville springs. Bearing cap 89 has a stud 93 press fitted into a cylindrical bore 95 formed in the rear of rotatable frustum cutter bit 58. The mutually engagable bearing surfaces 71 and 85 are preferably treated with the aforementioned diamond coating available from QQC, Inc.

In assembling the rotatable cutting bit insert arrangement 57 of FIG. 12, the compression spring or spring stack 91 is placed over stud 93, and the bit 58 is inserted from the front of the sleeve 81 as the stud 93 is pushed into stud mounting bore 95 from the rear. A press fit with the stud 93 penetrating to the optimum position in bore 95 is achieved when the bearing surfaces 71, 85 are in mutual sliding engagement, and a minimal gap 97 is left at the interface between the bearing cap 89 and the rear surface of sleeve 81 defining preferably diamond coated, preload thrust bearing surfaces therebetween. Under these conditions, the rotatable frustum cutter bit 58 is seated in taper lock bearing sleeve 81 leaving an air gap 87 at the rear. As with other rotatable frusto conical cutters, the cutting action at the forward end 83 of the cutter bit 58 tends to rotate the bit, and in the embodiment of FIG. 8, may serve to rotate the bit and/or the head 55.

An annular seal ring 79 is placed between the rear end 65 of head 55 and the outer end 63 of shank portion 53 to keep out dust and other contaminants from the bearing surfaces 73, 75.

Figure 13:
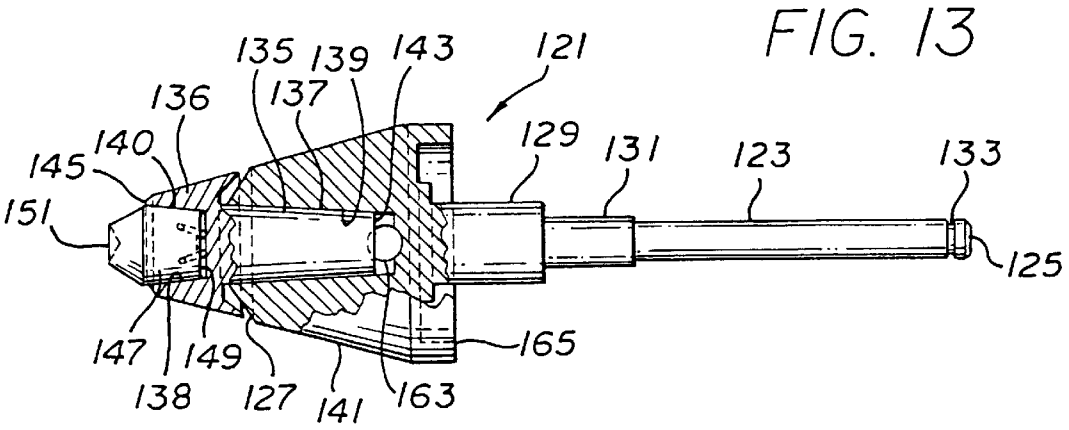

FIG. 13 also shows a rotatable head arrangement 121, but with an alternative bearing arrangement from that shown in FIG. 8. In the embodiment of FIG. 13, the head 121 has a shaft 123 rotatable within a shank of the type shown in FIG. 20 to be discussed hereinafter. The shaft 123 has a rear end 125 with an annular locking groove 133 which accommodates a locking ring when the head 121 is assembled in a shank portion.

Head 121 also is provided with a forward radial bearing support surface 129 and an intermediate radial bearing support surface 131, again cooperating with the shank portion for mutual rotation therewith.

The head 121 has an outer conical surface 141 with a rear end 165 and a forward end 127, the forward end 127 having a greater taper angle than the conical surface 141. The forward end 127 has a taper lock bore 139 therein for accommodating, in a taper lock fashion, the outer taper lock conical surface 137 of a cutting insert 136.

The forward end 145 of the cutting insert 146 has a taper lock conical surface 138 formed therein to receive a cutter bit 147 having a tapered outer surface 140. Accordingly, the cutter bit 147, insert 136, and head 121 are serially taper locked together.

Figure 14:
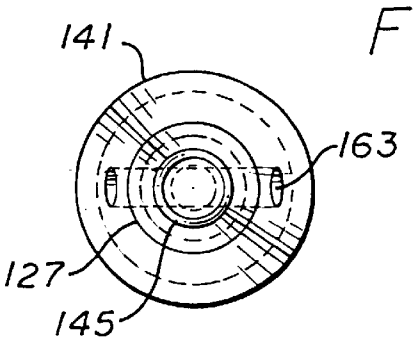

FIG. 14 is a left end view of the head 121 of FIG. 13, an access opening 163 being provided for removal of insert 136 as hereinbefore described.

Figure 15:
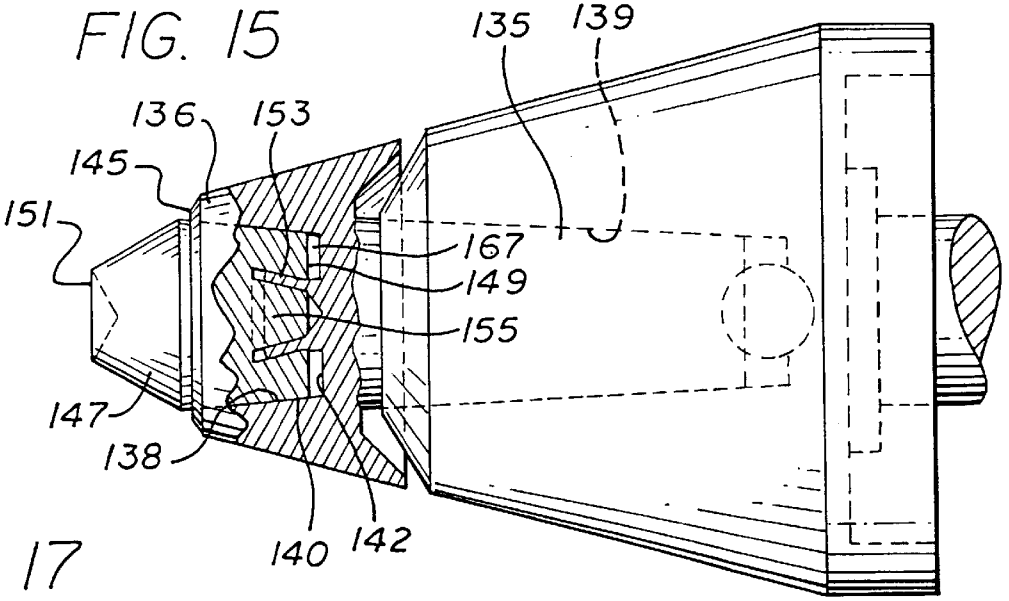
Figure 16:
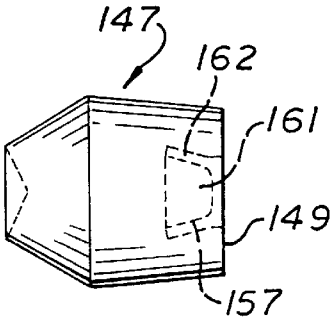
Figure 17:
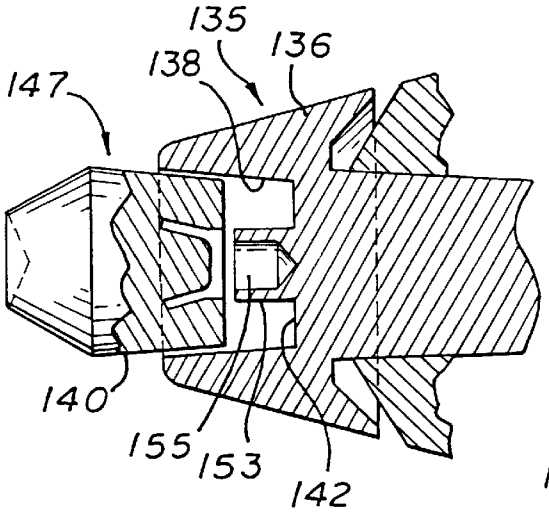

FIGS. 15–17 show, in enlarged representations, the features of attachment of the cutter bit 147 to the insert 136 and the insert 136 to the head 121. FIG. 17 shows a projecting tubular structure 153 extending from the bottom 142 of the opening 138. The tubular projection 153 has thin cylindrical walls, defining a cylindrical recess 155. On the mounting end 149 of cutter bit 147, as best seen in FIG. 16, a recessed truncated conical boss 161 is shown projecting rearwardly and having conical outer surface 157. As the cutter bit 147 is inserted into insert 136, the conical surface 157 of boss 161 begins to flare out the free end of the cylindrical projecting tube 153. As seen in FIG. 15, when the cutter bit 147 is fully taper locked within opening 138, the tubular projection 153 is flared outwardly to fill the annular conical void 162 in the mounting end of cutter bit 147. This flaring of the projecting tube 153 serves to permanently attach the cutter bit 147 to the insert 136, and yet the insert 136 has a long taper lock contact with the inner surface 139 of head 121. As a result, the more costly cutter bit 147 may be made small and permanently attached to an intermediate insert 136 made of less expensive material. Insert 136, nevertheless, is fully insertable into head 121 and releasable therefrom for replacement. This measure reduces the cost of the frustum cutting insert assembly comprising the insert 136 and cutter bit 147 while advantageously making a long and solid taper lock with the head 121.

Figure 18:
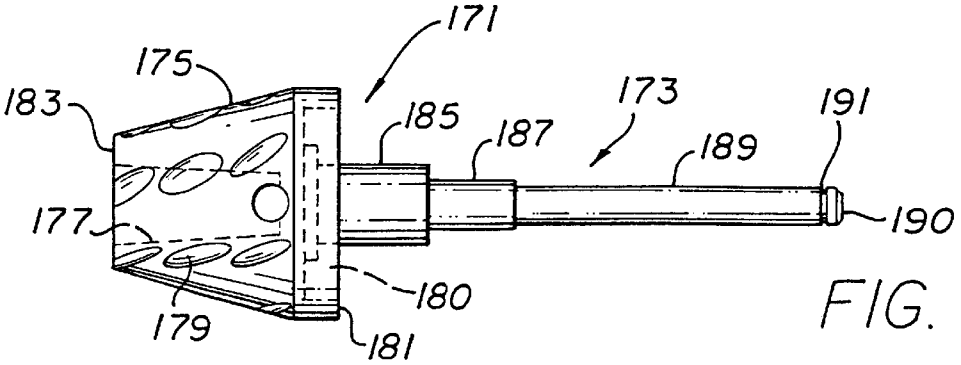
Figure 19:
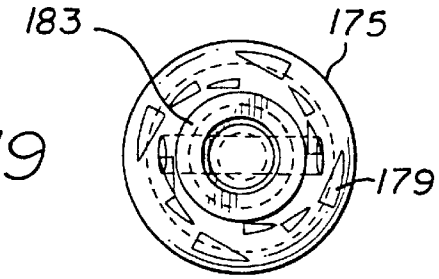
Figure 20:
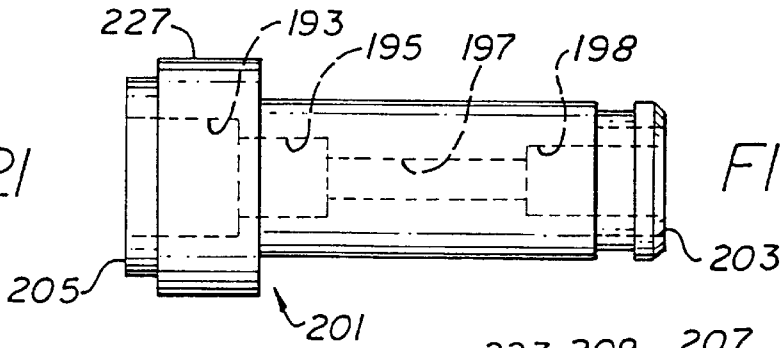

FIG. 18 is yet another head portion 171 that can be rotatably coupled to a shank portion 201 shown in FIG. 20. Head portion 171 has a rear end 190 with an annular locking ring groove 191. A shaft 189 extends from an intermediate radial bearing support surface 187 and a forward radial bearing support surface 185, the latter connected to the rear of the conical head portion 175. The conical head portion 175 has a rear end 181 and a front end 183, the latter having a tapered opening 177 for receiving a frustum cutting insert in taper lock fashion. FIG. 19 is a left end view of the head portion 171 shown in FIG. 18.

The outer surface of the conical head portion 175 has a series of guide grooves 179 having sharp edges to guide debris away from the cutting process as the head 171 rotates within shank 201.

The shank portion 201 shown in FIG. 20 accommodates any one of a number of different types of rotatable heads, the heads 121 and 171 of FIGS. 13 and 18 being examples only. Another example is shown in FIG. 22.

Figure 21:
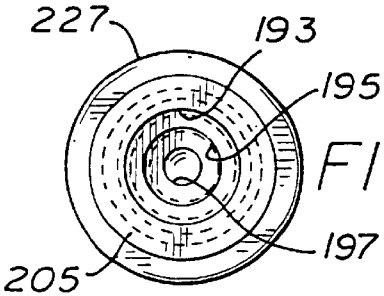

FIG. 21 is a right end view of the shank portion 201 of FIG. 20.

Figure 22:
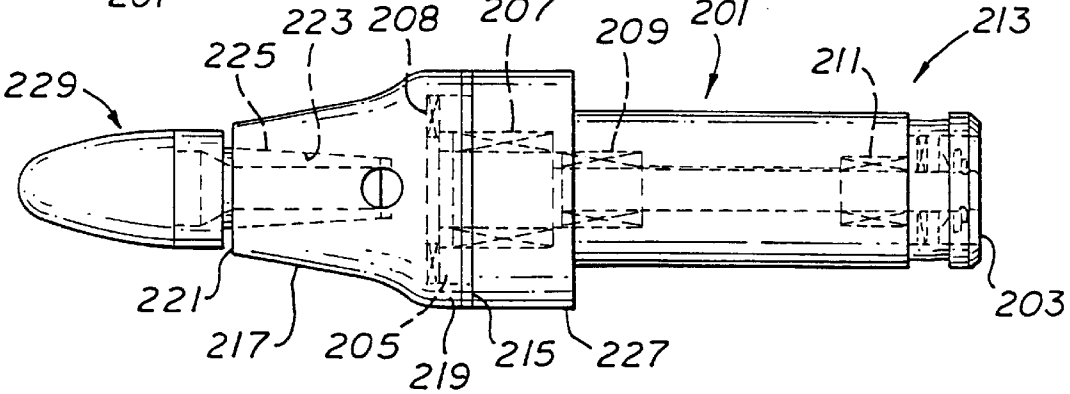
Figure 28:
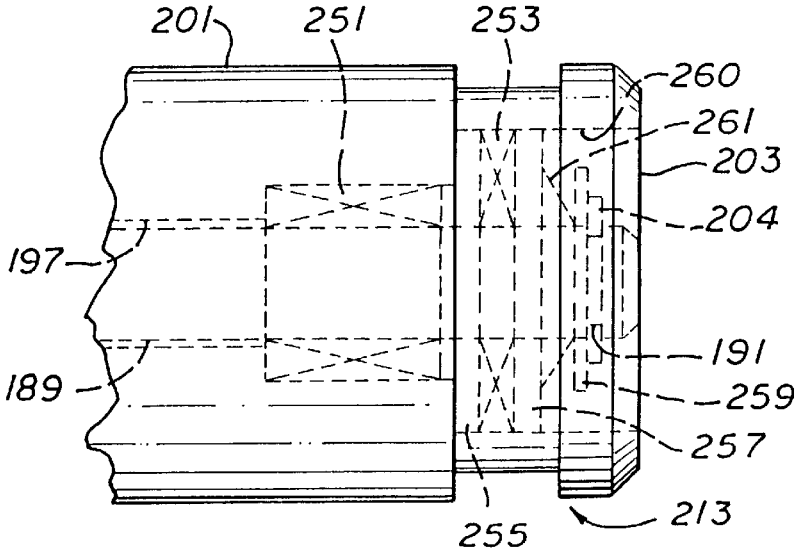

The fully assembled cutting bit arrangement shown in FIG. 22 will be used to explain the rotational relationship between the head portion and shank portion. FIG. 28 will also be helpful in the understanding of the configuration and function of the inner end 213 of the shank portion 201.

Returning to the combination of FIGS. 18 and 20, and viewing the assembled arrangement of FIG. 22, it will be observed that when the head 171 is inserted into shank portion 201, the shaft 189 is journalled in the elongated cylindrical passageway 197, and radial needle bearings are provided in three locations along the axis of the cutting bit arrangement so assembled: a bearing 211 at the rear of shank 201 between the shaft 189 and the rearward bearing support surface 198; the intermediate radial needle bearing 209 between the intermediate bearing support surfaces 187 and 195 on the head 171 and shank 201, respectively; and radial needle bearing 207 between the bearing surfaces 185 on head 171 and 193 on shank 201, respectively. An annular projecting flange 205 fits within annular void 180 in order to shield the bearing surfaces from dust and small particles resulting from the drilling/cutting action.

The head 217 of the FIG. 22 embodiment is rotatably mounted to the shank 201 employing thrust bearing 208 acting between the rotatable head 217 and the flange 205 of the shank 201. An annular sealing ring 215 is provided between the rear end 219 of the head 217 and the forward end of the collar 227 of shank 201. The sealing ring 215 keeps dust and small particles from reaching the bearing surfaces.

The front end 221 of head 217 in FIG. 22 has an opening with tapered conical walls 223 mating with the external conical wall 225 of a cutter insert 229, the two surfaces 223 and 225 effecting a taper lock therebetween.

Figure 23:
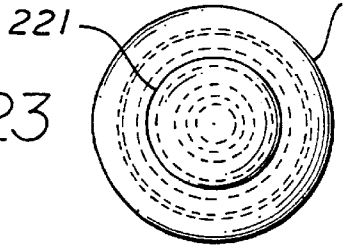

FIG. 23 is a right end view of the cutting bit arrangement shown in FIG. 22.

Figure 25:
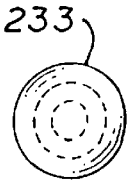
Figure 24:
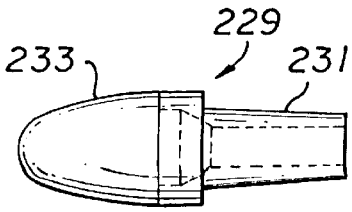
Figure 27:
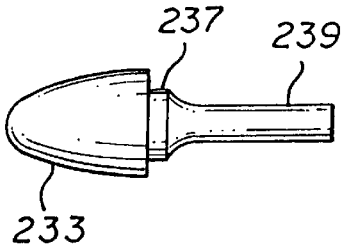
Figure 26:
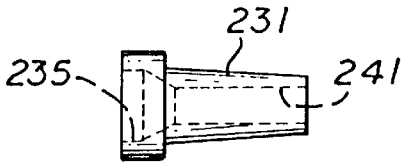

Referring to FIGS. 24–26, the cutter bit 229 is comprised of two pieces, again to conserve the costly hardened material used for the cutting portion 233 of the cutter bit 229. In this assembly, the cutting portion 233 has a cylindrical shoulder 237 and a shaft 239.

The shaft 239 fits in a cylindrical bore 241 in a cutter insert holder 231. The cutting portion 233 is inserted in holder 231, and the shoulder 237 is press fitted into the cylindrical press fit opening 235. The result is a taper lock holder made of less expensive material press fitted to a more costly cutting bit 233.

FIG. 28 shows the inner end portion of the shank 201 of FIG. 20 with the shaft 189 of the FIG. 18 embodiment inserted therein. The shaft 189 is inserted completely into the shank portion 201 which has a wide cylindrical opening 260 at its extreme inner end. After the shaft 189 is fully inserted in passageway 197, a first washer 255 is inserted over shaft 189, then a radial needle bearing 253 is placed against washer 255, and a second washer 257 is placed against bearing 253. A spring 261, preferably a belville spring, is then inserted over shaft 189, followed by another washer 259 serving as a backing for a lock ring 204 fitting into the annular groove 191 in shaft 189.

The compression spring 261 tends to pull the shaft 189 rearwardly of the shank portion 201 which, in turn, applies a preload to the thrust bearing surfaces of the various embodiments described.

Figure 30:
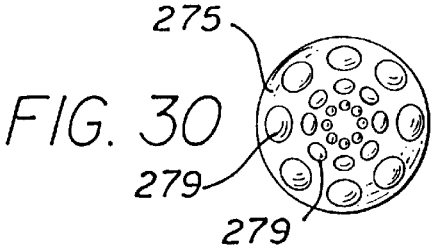
Figure 29:
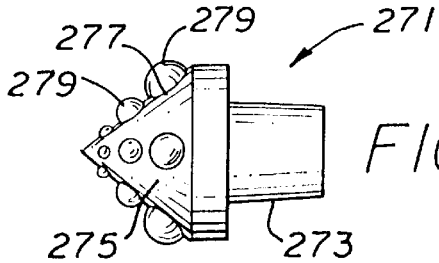

FIG. 29 shows another configuration for a cutter bit insert 271 having a plurality of various sizes of dimples 277 within which pimples, i.e. pellets, or lugs, 277 having spherical exposures, are fitted, the pimples 277 being distributed along a conical surface 275. A taper lock shank 273 permits the cutter bit insert 271 to be taper locked into any one of the described taper lock receivers in the head portions of the cutting bit arrangements. FIG. 30 is a left end view of the cutter bit insert shown in FIG. 29.

Figure 32:
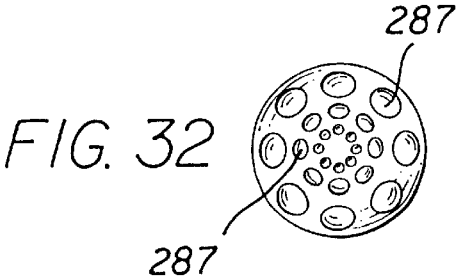
Figure 31:
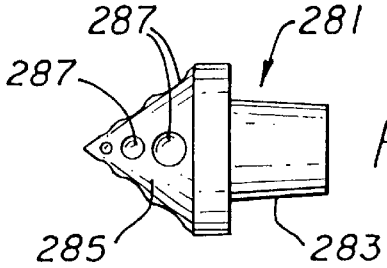

FIG. 31 is a view similar to that of FIG. 29, but without spherical pellets (pimples). Thus, cutter bit insert 281 has a plurality of sharp edge cutting dimples, or notches, 287 on the conical surface 285 and a taper lock shaft 283. FIG. 32 is a left end view of the cutter bit insert of FIG. 31.

Figure 33A:
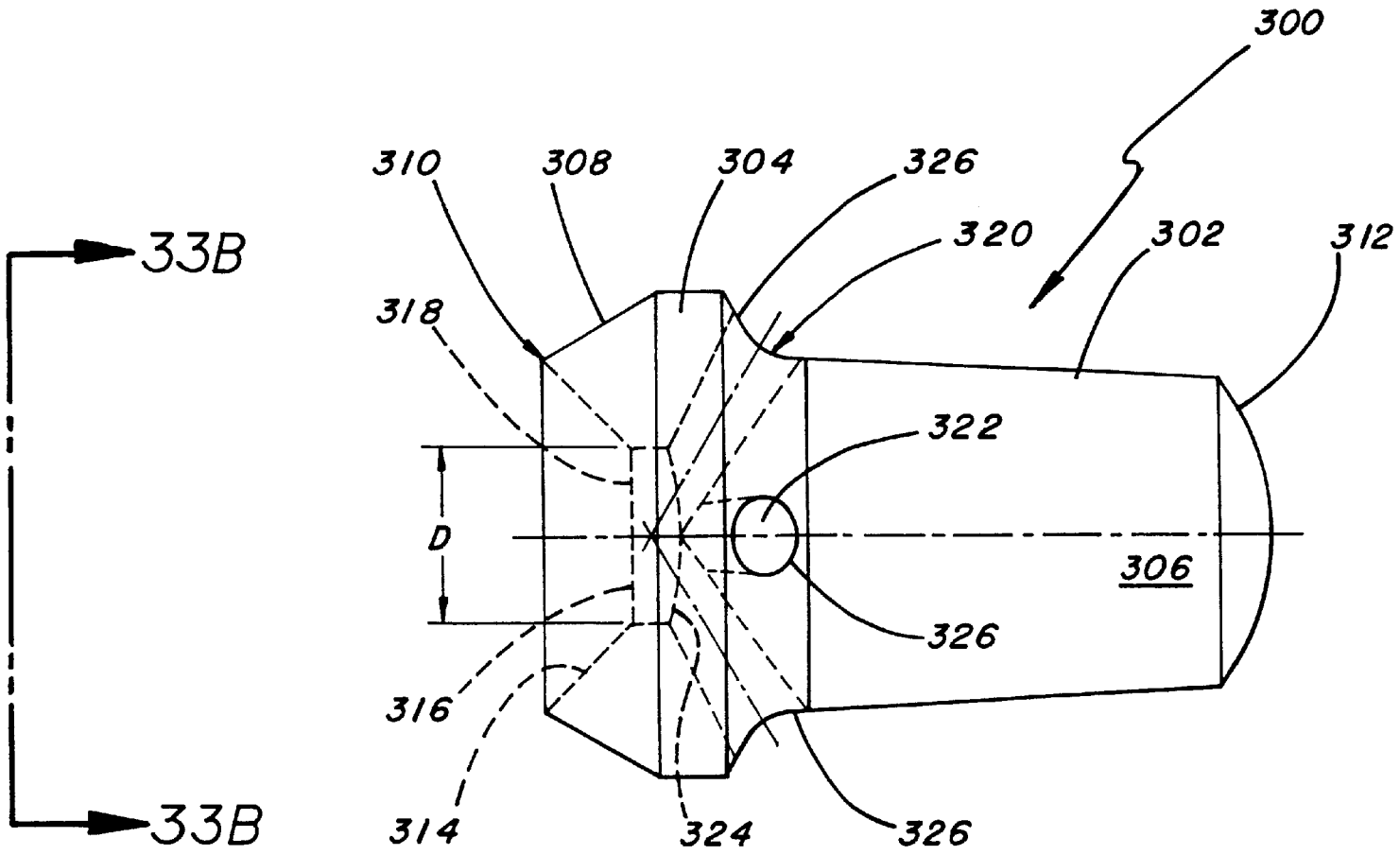
FIGS. 33A and 33B illustrates a preferred embodiment of a frustum cutting insert according to the principals of the present invention.
Figure 33B:
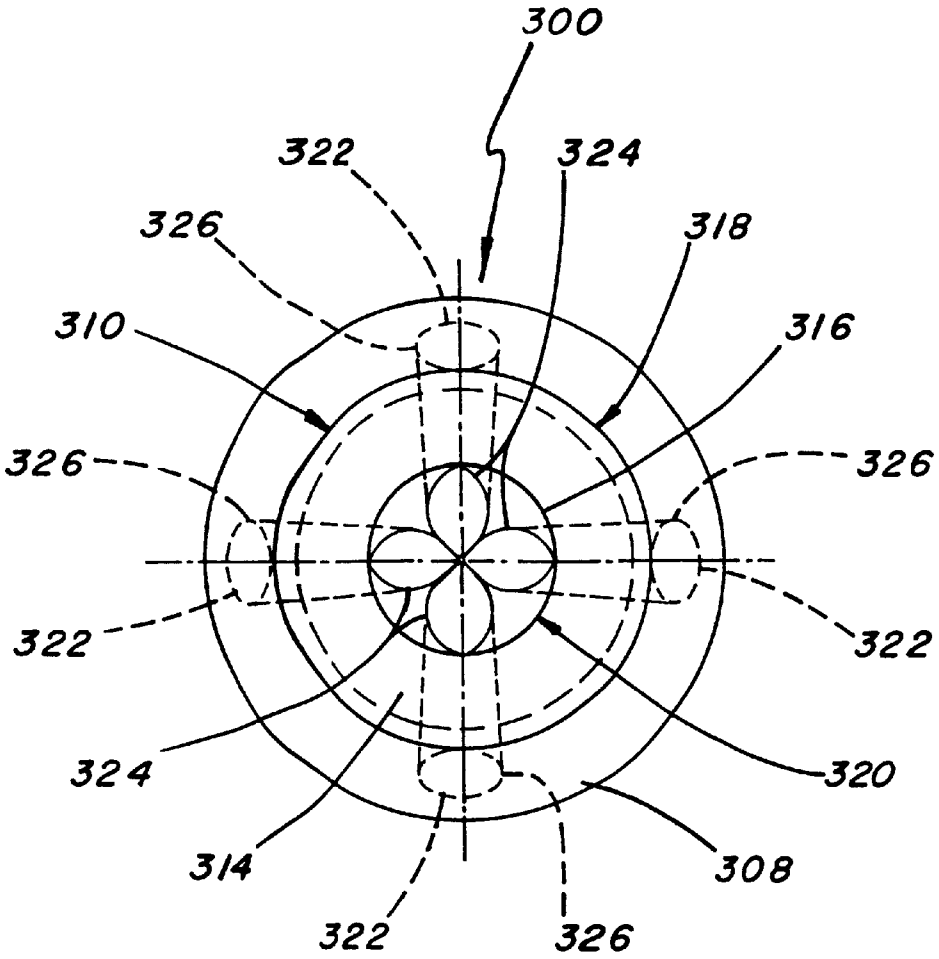

According to the principles of the present invention, a vent means is provided in the cutting insert. As shown on FIGS. 33A and 33B, there is an embodiment generally designated 300 of a frustum cutting insert 302 having a shank portion 302 and a frustum cutting head portion 304. The outer peripheral walls 306 of the shank portion 302, in this embodiment of the present invention, have a tapered contour as described above for providing a taper lock when inserted into a holder in a manner similar to that described above. The head portion 304 of the frustum cutting insert 300 has an outer surface 308 tapering outwardly from a cutting edge 310 and extending in the direction of a back end 312. The head portion 304 also has interior walls 314 tapering inwardly from the cutting edge 310 and extending in the direction of the back wall 312 to a base wall 316 having a predetermined diameter "D" defining a cavity 318 comprising a first stage of a vent means 320.

A plurality of apertures 322 of which four are shown in the embodiment 300 comprise a second stage of the vent means 320 and have a first end 324 at the cavity 318. The apertures 322 extend outwardly and rearwardly toward the back end 312 and have an outer end 326 in regions spaced rearwardly from the cutting edge 310. The vent means 320 provides a flow passage for powder generated by the cutting operation of the frustum cutting bit 300 to vent to regions away from the area of cutting by the cutting edge 310 and thereby prevents the build up of a powder "bubble" at the cutting edge 310. Since powder packing or a powder bubble at the cutting edge 310 would cause an increase in the power required to drive the frustum cutting insert 300 the vent means 320 reduces the power required and also minimizes the danger of a powder explosion and/or other major safety hazards during the cutting operation.

Therefore, the vent means 320 allows the use of the efficient frustum or concave type of cutting insert for cutting or drilling in virtually any type material In preferred embodiments of the present invention incorporating a vent means 320, it is preferred that the apertures 322 have an increasing cross section area from the first end 324 to the outer end 326 and thus has an outwardly tapering cross section so that the outer end 326 is larger in Area than the inner end 324. The geometrical configuration of the apertures may be a circular cross section, and oval cross section or any other desired configuration. The entire frustum cutting bit 300 may be fabricated from carbon steel or any other desired material suitable for the purpose.

While a taper lock surface in the outer surface 306 of the shank portion 302 is provided for the retention of the frustum cutting bit 300, any other type of retention means may be utilized as desired for any particular application.

Figure 34:
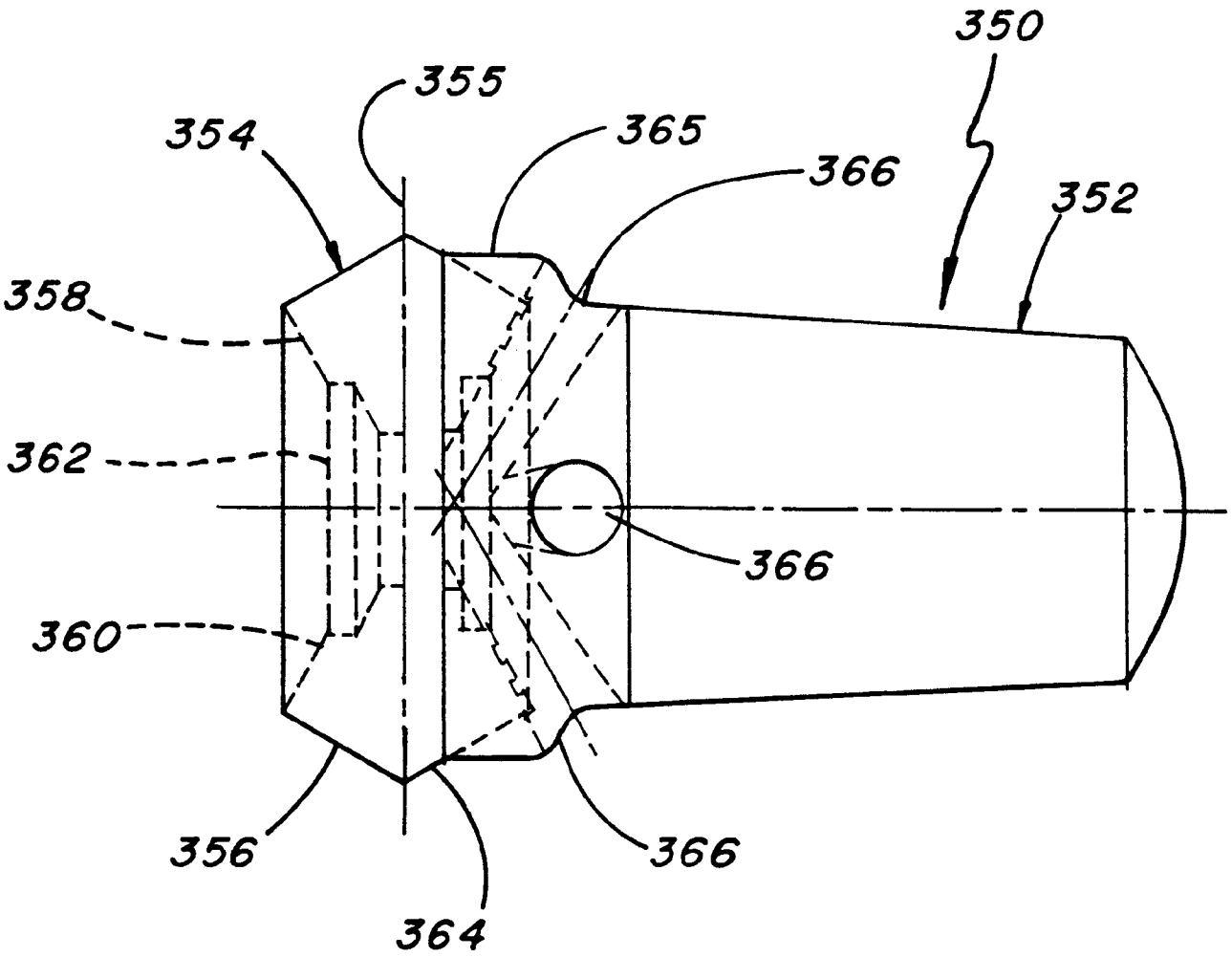

FIG. 34 illustrates another embodiment of the present invention generally designated 350. The frustum cutting bit 350 is fabricated from two separate parts: a shank portion 352 and a frustum cutting head portion 354. The frustum cutting head portion 354 has a cutting end 355 and the cutting end 355 is generally similar to the frustum cutting head 304 described above in embodiment 300 and has a cutting edge 356 and inner walls 358 tapering inwardly therefrom to a vent means 360 comprised of a cavity 362 forming a first stage of the vent means 360. The cavity 362 is similar to the cavity 318 described above.

The frustum cutting head portion 354 also has a coupling portion 364 which may be fabricated in a configuration similar to the cutting end 355 and provides an attachment for coupling the head portion 354 to the shank portion 352 by brazing or any other desired means of attachment at the mating area generally designated 365 therebetween. In the embodiment 350, the coupling portion 364 is in the configuration of a mirror image of the frustum cutting head portion about the medial plane 355. The shank portion has a plurality of apertures 366 which communicate with the cavity 363 and which may be similar to the apertures 322 described above. The vent means 360 provides the powder flow passage as described above during the cutting operation.

In the embodiment 350, the shank portion may be fabricated from tool steel and the cutting head portion 354 may be fabricated from the more expensive tungsten carbide. The tungsten carbide has been found to provides a more efficient cutting operation than the tool steel even though more costly to fabricate.

Figure 35:
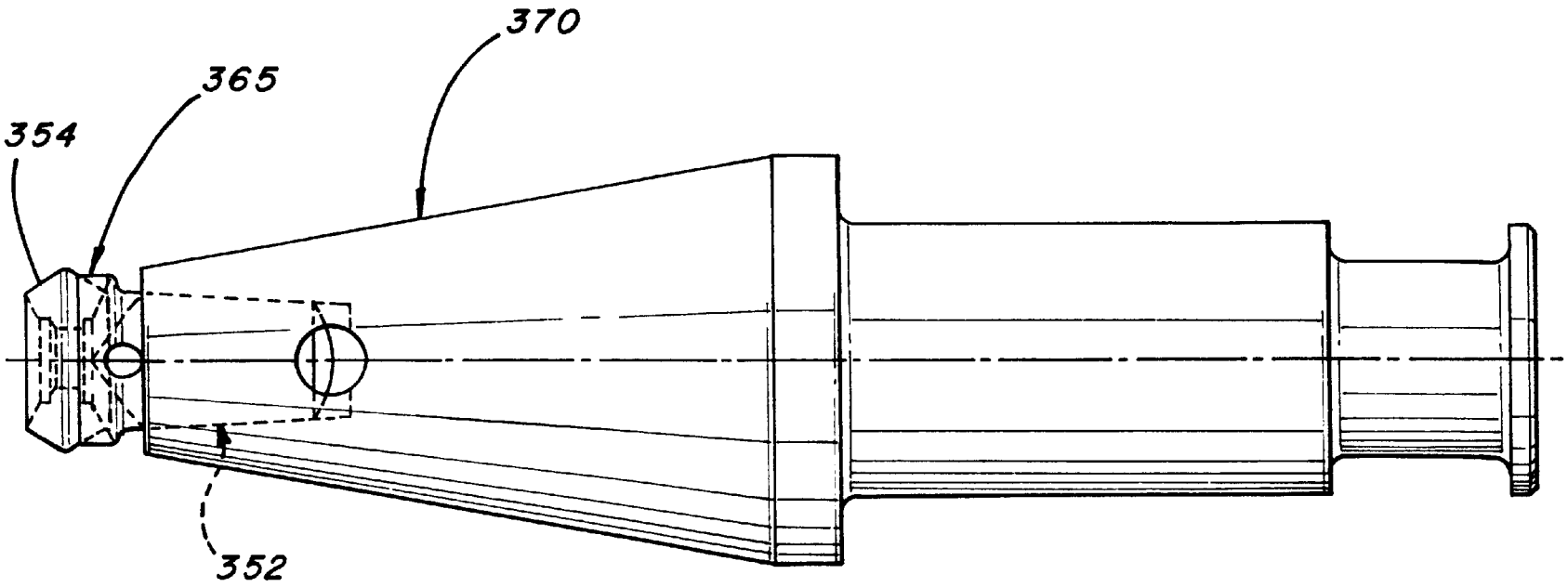

FIG. 35 shows the mounting of the frustum cutting insert of embodiment 350 in a holder generally designated 370 having tapered walls 372 and which is similar to the holder illustrated in FIG. 1 above. The taper lock provided by the tapered shank portion 352 is similar to that described above for example in connection with the embodiment shown in FIG. 1. The frustum cutting bit of embodiment 300 may be coupled to a holder in a manner similar to that shown in FIG. 35.

Figure 36:
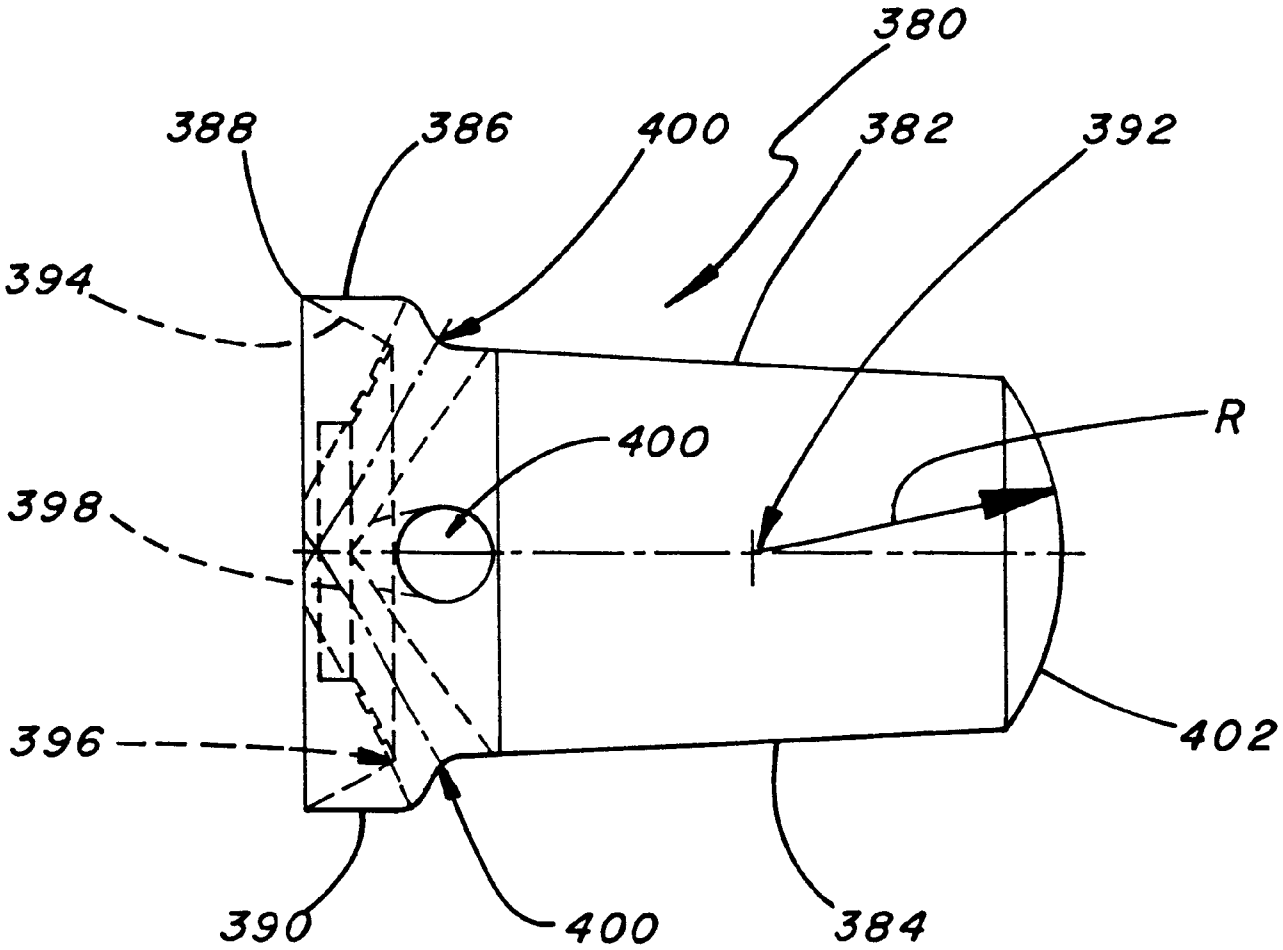

FIG. 36 illustrates an embodiment 380 of a modified form of the cutting bit generally designated 382. The bit 382 has a shank portion 384 which may be similar to the shank portions described above and has taper locking outer surface 384. A cutting head 386 is provided and has a cutting edge 388. The outer wall 390 of the cutting head 386 is, in this embodiment of a uniform diameter and is cylindrical in configuration rather than conical as shown in the embodiments described above and is concentric to the center line 392. The cutting head has inner walls 394 tapering inwardly to a cavity 396 forming the first stage of a vent means 398.

Apertures 400 are provided to comprise the second stage of the vent means 398 and may be similar to the apertures described above. The vent means 398 provides a flow passage for any powder so that the powder may be vented from regions at the cutting edge 388 to regions spaced rearwardly toward the back end 402 of the shank portion 382. The back may be curved in the form of a section of a sphere as indicated by the radius "R" for mounting in a holder (not shown) as described above in connection with the structure shown in FIG. 1.

While only certain embodiments of the invention have been set forth above, alternative embodiments and various modifications will be apparent from the above description and the accompanying drawing to those skilled in the art. These and other alternatives are considered equivalents and within the spirit and scope of the present invention. Further, the many structural configurations of the frustum or other cutting insert shown in FIGS. 1 through 32 may be incorporated, as applicable, in the embodiments of the cutting inserts shown in FIGS. 33 to 36. For example, the variations in the cutting tip illustrated with the various flute configurations therein, the various connection structures between the cutting insert and the body and the like may be advantageously utilized in connection with the embodiments shown in FIGS. 33 to 36.

I claim:

1. A frustum cutting bit arrangement, comprising:

a shank portion for mounting in, and to be retained by, a rotary cutting tool body, said shank portion having an axis, an inner axial end, and an outer axial end;

a head portion having an axis coincident with said shank portion axis, a front axial end, and a rear axial end, said rear end coupled to said shank portion outer end, and said front end having a conical cavity therein diminishing in diameter from said front end toward said rear end;

a frustum cutting insert having an axis coincident with said head portion axis, a forward axial end, a back axial end, and an outer conical surface diminishing in diameter from said forward end toward said back end, said conical cavity and said outer conical surface having substantially the same taper, said frustum cutting insert fitting into said cavity in a taper lock;

said frustum cutting insert comprising:

a conical shaped outer surface increasing in diameter from said forward axial end toward said back axial end;

a conical shaped inner surface decreasing in diameter from a first end at said forward axial end toward said back axial end to an inner end, and the intersection of said outer surface and said inner surface defining a cutting edge;

first walls defining a cavity spaced axially inwardly from said cutting edge and said inner end of said inner walls at said cavity;

second walls defining aperture means extending from a first end at said cavity to a second end in regions external said cutting insert to define a flow passage from regions adjacent said cutting edge into said cavity and through said aperture means to regions external said frustum cutting insert.

2. The frustum cutting bit arrangement defined in claim 1 wherein:

said aperture means comprises a plurality of aperture paths.

3. The frustum cutting bit arrangement defined in claim 2 wherein:

each of said aperture paths has an increasing cross sectional area from said first end thereof to said second end thereof.

4. The frustum cutting bit arrangement defined in claim 3 wherein:

said second end of said aperture means is in regions space axially toward said back axial end from said cutting edge.

5. A frustum cutting insert comprising:

a cutting end portion at a forward axial end and a shank portion at a back axial end, said cutting end portion having a conical shaped outer surface increasing in diameter from a forward axial end toward a back axial end;

a conical shaped inner surface decreasing in diameter from a first end at said forward axial end toward said back axial end to an inner end, and the intersection of said outer surface and said inner surface defining a cutting edge;

first walls defining a cavity spaced axially inwardly from said cutting edge and said inner end of said inner walls communicating with said cavity;

second walls defining aperture means extending from a first end at said cavity to a second end in regions external said cutting insert to define a flow passage from regions adjacent said cutting edge into said cavity and through said aperture means to regions external said frustum cutting insert.

6. The frustum cutting bit arrangement defined in claim 5 wherein:

said aperture means comprises a plurality of aperture paths.

7. The frustum cutting bit arrangement defined in claim 6 wherein:

each of said aperture paths has an increasing cross sectional area from said first end thereof to said second end thereof.

8. The frustum cutting bit arrangement defined in claim 5 wherein:

said second end of said aperture means is in regions spaced axially toward said back axial end from said cutting edge.

9. The frustum cutting bit arrangement defined in claim 5 wherein:

said cutting end portion and said shank portion are unitarily fabricated.

10. The frustum cutting bit arrangement defined in claim 5 wherein:

said cutting end portion and said shank portion or fabricated separately.

11. The frustum cutting bit arrangement defined in claim 10 wherein:

said cutting end portion is fabricated from tungsten carbide and said shank portion is fabricated from tool steel.

12. The frustum cutting bit arrangement defined in claim 10 wherein:

said cutting end portion has a cutting section at a forward end thereof and a coupling section at a rear end thereof, and said shank portion is attached to said coupling section.

13. The frustum cutting bit arrangement defined in claim 10 wherein:

said attachment of said shank portion to said coupling section is brazing.

14. The frustum cutting bit arrangement defined in claim 10 wherein:

said coupling section is a mirror image of said cutting section about a medial plane thereof.

15. A frustum cutting insert comprising:

a cutting end portion at a forward axial end and a shank portion at a back axial end, said cutting end portion having a cylindrical shaped outer surface concentric with an axis of said cutting insert and extending from a forward axial end toward a back axial end;

a conical shaped inner surface decreasing in diameter from a first end at said forward axial end toward said back axial end to an inner end, and the intersection of said outer surface and said inner surface defining a cutting edge;

first walls defining a cavity spaced axially inwardly from said cutting edge and said inner end of said inner walls communicating with said cavity;

second walls defining aperture means extending from a first end at said cavity to a second end in regions external said cutting insert to define a flow passage from regions adjacent said cutting edge into said cavity and through said aperture means to regions external said frustum cutting insert.

16. The frustum cutting bit arrangement defined in claim 15 wherein:

said aperture means comprises a plurality of aperture paths.

17. The frustum cutting bit arrangement defined in claim 16 wherein:

each of said aperture paths has an increasing cross sectional area from said first end thereof to said second end thereof.

18. The frustum cutting bit arrangement defined in claim 15 wherein:

said second end of said aperture means is in regions spaced axially toward said back axial end from said cutting edge.

19. The frustum cutting bit arrangement defined in claim 15 wherein:

said cutting end portion and said shank portion are unitarily fabricated.

20. The frustum cutting bit arrangement defined in claim 15 wherein:

said cutting end portion and said shank portion or fabricated separately.

21. The frustum cutting bit arrangement defined in claim 20 wherein:

said cutting end portion is fabricated from tungsten carbide and said shank portion is fabricated from tool steel.

22. The frustum cutting bit arrangement defined in claim 20 wherein:

said cutting end portion has a cutting section at a forward end thereof and a coupling section at a rear end thereof, and said shank portion is attached to said coupling section.

23. The frustum cutting bit arrangement defined in claim 20 wherein:

said attachment of said shank portion to said coupling section is brazing.

24. The frustum cutting bit arrangement defined in claim 20 wherein:

said coupling section is a mirror image of said cutting section about a medial plane thereof.

* * * * *